United States Patent [19]

Brautigam

[11] Patent Number: 4,970,829

[45] Date of Patent: Nov. 20, 1990

[54] WEATHERSTRIPPING

[76] Inventor: Richard H. Brautigam, 10 Georgian Cir., Newark, Del. 19711

[21] Appl. No.: 508,652

[22] Filed: Apr. 13, 1990

[51] Int. Cl.[5] ..... E06B 7/16

[52] U.S. Cl. ..... 49/489

[58] Field of Search ..... 49/488, 489, 493

[56] References Cited

U.S. PATENT DOCUMENTS

| | | | |
|---|---|---|---|
| 3,175,256 | 3/1965 | Horton | 49/493 X |
| 3,266,190 | 8/1966 | Jackson | 49/489 |
| 3,404,487 | 10/1968 | Johnson | 49/489 |
| 3,616,137 | 10/1971 | Horton | 49/489 X |
| 3,935,043 | 1/1976 | Kessler | 49/489 X |
| 4,214,930 | 7/1980 | Burrows | 49/489 X |
| 4,242,392 | 12/1980 | Yackiw | 49/489 X |
| 4,245,368 | 1/1981 | Cotey et al. | 15/229.1 X |
| 4,288,483 | 9/1981 | Miska et al. | 49/489 X |
| 4,352,845 | 10/1982 | Miska | 49/489 X |
| 4,372,629 | 2/1983 | Propst et al. | 49/489 X |
| 4,458,450 | 7/1984 | Young et al. | 48/489 |

*Primary Examiner*—Gary L. Smith
*Assistant Examiner*—Jerry Redman
*Attorney, Agent, or Firm*—Connolly & Hutz

[57] ABSTRACT

The weatherstripping includes a backing having pile fibers extending upwardly from the face of the backing. A heavy yarn is secured on each side of the pile longitudinally of the backing on the backing face to force the pile fibers to stand more erect which results in a better seal while reducing side friction when the weatherstripping is inserted in the channel of a door or window.

16 Claims, 1 Drawing Sheet

WEATHERSTRIPPING

BACKGROUND OF INVENTION

Weatherstripping is conventionally used for doors and windows to provide a seal. In a common practice, the doors or windows would have a channel into which the weatherstripping would be inserted with pile fibers extending outwardly from the backing face thereby obtaining the seal. A disadvantage with these arrangements as practiced in the prior art is in the encounter of objectionable friction in attempting to slide the weatherstripping into the channels. In this regard, the pile fibers while initially in an erect condition tend to lose that erect condition and adversely affect the seal.

SUMMARY OF THE INVENTION

An object of this invention is to provide an improved weatherstripping structure which overcomes the above disadvantages of the prior art.

A further object of this invention is to provide such an improved weatherstripping seal structure which can be economically manufactured and which can be installed in a conventional manner.

In accordance with this invention, the weatherstripping includes a backing having pile fibers extending from the backing face. The invention is characterized by the provision of heavy yarn, monofilament or wire on each side of the pile fibers on the backing face to act as a support for the pile fibers so as to maintain the fibers in the erect condition. As a result, when the weatherstripping is slid into the channel of a door or a window, less friction is encountered and an effective seal is maintained.

THE DRAWINGS

DETAILED DESCRIPTION OF THE DRAWINGS

Figure 1:
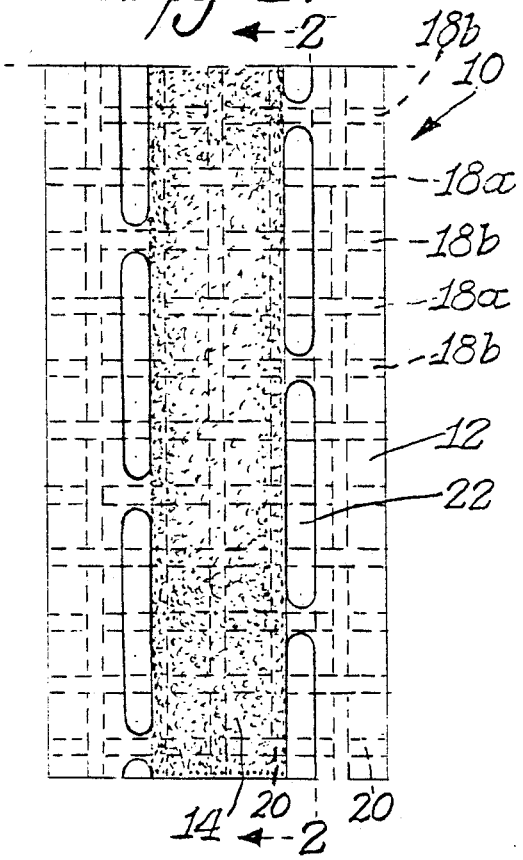
FIG. 1 is a top plan view of a weatherstripping in accordance with this invention.
Figure 2:
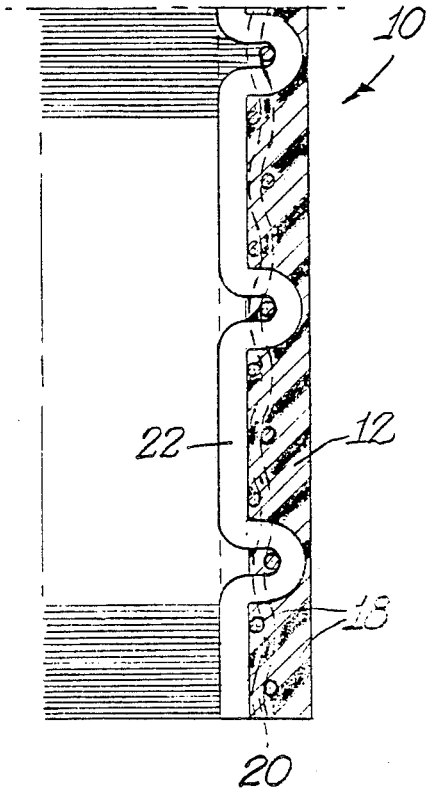
FIG. 2 is a cross-sectional view in elevation taken through FIG. 1 along the line 2—2.
Figure 3:
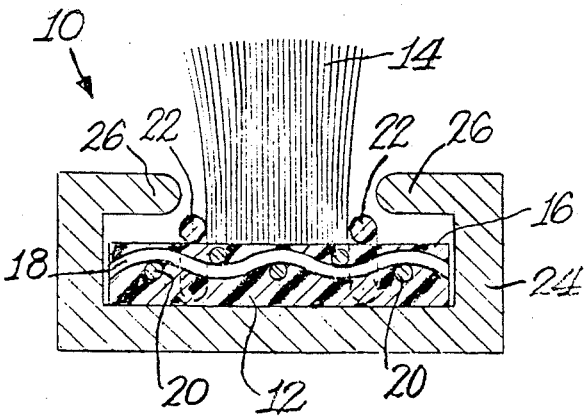
FIG. 3 is an end elevation view of the weatherstripping shown in FIGS. 1–2 mounted in a channel of a door or a window.

FIGS. 1–3 show a weatherstripping 10 in accordance with this invention. Advantageously, weatherstripping 10 includes known structural details whereby the invention lends itself to ready adaption to conventional manufacturing practices. In this respect, weatherstripping 10 includes a backing 12 made of any suitable known material. For example, the backing strip 12 may be woven of textile fibers either natural or synthetic. The backing strip has formed thereon bodies of upstanding resilient long pile fibers 14 which likewise may be of conventional construction made from conventional materials such as plastic materials including polypropylene, nylon, orlon or may be made of natural fibers such as mohair, goat hair, wool, jute or the like or any combination thereof. The pile fibers 14 may be formed by weaving or may be fixed by mechanical embodiments, flocking, tufting or other known methods.

In the illustrated embodiment, backing strip 12 is, for example, 0.270 inches wide while pile fibers 14 extend, for example, 0.250 inches above backing face 16. Pile fibers are arranged longitudinally down the center of backing 12. Although not illustrated, a thin center barrier may be provided along the longitudinal center line of backing face 16 extending longitudinally through the center of the fiber pile 14. In one practice of the invention, polypropylene may be used as the material for the pile, polyester for the thin barrier and polypropylene for the backing strip. In the illustrated embodiment, longitudinal threads or strands 20 and transverse threads or strands 18 form the weave for the basic weatherstrip structure as is also known in the art.

In accordance with this invention, support is provided on each side of pile 14 by a heavy yarn 22 extending longitudinally from backing face 16 between the pile 14 and the outer edge of face 16. In the embodiment illustrated in FIGS. 1–3, yarn 22 is secured to backing face 16 by being woven to backing 12 in a repetitive pattern. As shown therein, yarn 22 extends from backing face 16 and is woven into backing 12 after traversing a plurality of transverse threads **18*a* whereupon yarn 22 would slip under at least one transverse thread 18*b* and then again extend on the outer surface of backing face 16. For example, as shown in FIG. 1, yarn 22 would extend over three transverse threads 18*a* and then extend or be woven under transverse threads 18*b* etc. As also shown in FIG. 1, the woven-in locations of yarn 22 are staggered when comparing one yarn with the other for greater strength and stability. In this respect, the area where yarn 22 is woven in on one side of pile 14 would be offset from the area where its companion yarn is woven in on the other side of pile 18. The staggering is symmetrical in that yarn 22 emerges at about midway of its parallel yarns 22**.

Although FIG. 1 illustrates yarn 22 to extend on the outer surface of backing face 16 over a distance corresponding to three strands or threads 18, the invention may also be practiced with a larger or smaller number of strands disposed below yarn 22. It is preferable, however, that yarn 22 extend over from three to seven strands before being woven into backing 12 and then resurfacing where it would again extend over three to seven strands.

Figure 4:
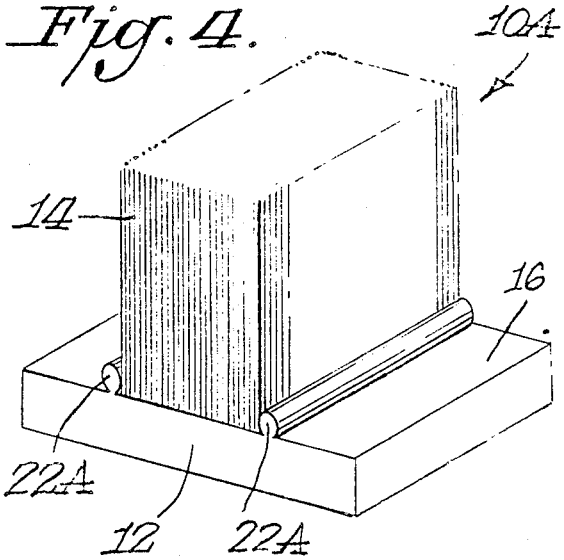
FIG. 4 is a perspective view of a modified form of weatherstripping in accordance with this invention.

FIG. 4 illustrates a further embodiment of this invention wherein yarn 22A is secured to backing 12 by ultrasonic welding. Otherwise, weatherstripping 10A would be of the same construction as weatherstripping 10 of FIGS. 1–3.

As shown in FIG. 3, weatherstripping 10 (or 10A) would be mounted to a door or window which includes a channel or groove 24 having a pair of inwardly directed lips or flanges 26. Channel 24 may be made in any conventional manner such as from a suitable plastic such as PVC or from other materials such as aluminum. As illustrated in FIG. 3, backing 12 would be slid into channel member 24 below lips 26. Similarly while pile 14 tends to fall, yarn 22 provides sufficient support to maintain pile 14 to minimize contact with lips 26. This clearance effectively reduces friction during insertion. Additionally, a better seal or improved weather resistance is obtained by making the pile bundle more dense because yarns 22 tend to hold pile 14 more upright than if pile 14 were unsupported.

In the embodiment shown in FIG. 3, channel 24 may have a base width of 0.310 inches. Lips 26 may extend 0.050 inches above the base and be separated by a distance of 0.180 inches. Backing 12 may be 0.270 inches wide and 0.035 inches high. Alternatively, channel 24 may be 0.210 by 0.050 inches with the spacing between lips 26, 26 being 0.125 inches and backing 12 may be 0.187 by 0.035 inches.

Yarn 22 is preferably made of polypropylene or other suitable low friction material. In the FIG. 4 embodiment a plastic material such as polyester which lends itself to ultrasonic welding or adhesive securement may be used. Where channel 24 has the above dimensions, yarn 22 would have a maximum diameter of about 0.035 inches and preferably 0.025 inches and more preferably a maximum diameter of 0.020 inches. For other size channels, other diameters would be used as long as yarn 22 is of sufficiently large size to effectively support pile 14 on each side thereof to force the pile fibers to stand more erect by giving them support on the outside. As a result, as noted above, this provides a better seal while also reducing the side friction that has been found objectionable in the prior art.

The invention has been specifically described with respect to member 22 being a yarn. It is to be understood, however, that the term "yarn" is meant to include such structure elements as monofilaments and wire. For example, where element 22 would be a wire, such as a metal wire, the wire would lay on surface 16 on each side of pile fibers 14 and would be held in place by transverse threads 18 coming up above surface 16 over the wire and then back into backing 12.

As can be appreciated, the invention thus provides a relatively large diameter yarn, monofilament or wire which may be woven, welded or otherwise adhered to the surface 16 of the weather seal backing 12 adjacent to the pile fibers 14. The purpose of this arrangement is to support the pile fibers 14 in a more erect position. Supporting these pile fibers 14 more directly improves the seal and reduces the possibility of contact between the pile fibers 14 and the edges of lips 26 in the channel groove 24. Reducing this contact between the pile fibers 14 and edge of lips 26 thereby reduces the friction between them when the weather seal is pulled in the channel groove 24 thus making installation significantly easier.

What is claimed is:

1. A weatherstripping for fitment into a window groove or the like and comprising a backing strip having a backing face, pile fibers secured to said backing strip and extending outwardly away from said backing face, said pile fibers being located longitudinally along the central portion of said backing face spaced from the side edges of said backing strip, a yarn having a diameter larger than the pile fibers secured to said backing strip on backing face on each side of said pile fibers, and said yarns abutting against said pile fibers to support said pile fibers and maintain said pile fibers erect while minimizing friction and maximizing sealing capabilities when said weatherstripping is slid into the groove of a door or window or the like.

2. The weatherstripping of claim 1 wherein said yarns are ultrasonically welded to said backing strip.

3. The weatherstripping of claim 1 wherein said yarns are connected to said backing strip by being woven to said backing strip.

4. The weatherstripping of claim 3 wherein said backing strip includes spaced longitudinal strands and spaced transverse strands, each of said yarns being woven by a repetitive pattern wherein each of said yarns extends above a plurality of transverse strands and is woven under a single transverse strand.

5. The weatherstripping of claim 4 wherein said repetitive pattern of one of said yarns is staggered with respect to said repetitive pattern of said yarns on the opposite side.

6. The weatherstripping of claim 5 wherein said staggering is symmetrical.

7. The weatherstripping of claim 6 wherein said repetitive pattern includes each of said yarns extending over from three to seven transverse strands.

8. The weatherstripping of claim 7 wherein said pattern includes each of said yarns extending over three transverse yarns.

9. The weatherstripping of claim 1 wherein said yarns are made of polypropylene.

10. The weatherstripping of claim 9 wherein each of said yarns has a maximum diameter of about 0.035 inches.

11. The weatherstripping of claim 1 wherein each of said yarns has a maximum diameter of 0.035 inches.

12. The weatherstripping of claim 10 wherein said yarns are monofilaments.

13. The weatherstripping of claim 1 wherein said yarns are wires secured to said backing by transverse threads of said backing.

14. The weatherstripping of claim 1 wherein said yarns are secured to said backing by ultrasonic welding.

15. The weatherstripping of claim 1, in combination with a window or door having a channel with overhanging lips, and said weatherstripping being slidably inserted in said channel with said yarns having minimal contact with said overhanging lips.

16. The combination of claim 14 wherein said pile fibers have minimal contact with said overhanging lips.

* * * * *